US005266920A

United States Patent [19]

Langner

[11] Patent Number: 5,266,920

[45] Date of Patent: Nov. 30, 1993

[54] MAGNET FOR USE ON A REFRIGERATOR OR THE LIKE

[76] Inventor: Eli Langner, 25 St. Nicholas St., Lynbrook, N.Y. 11561

[21] Appl. No.: 865,950

[22] Filed: Apr. 9, 1992

[51] Int. Cl.[5] ..... G08B 3/00; G08B 25/08

[52] U.S. Cl. ..... 340/384 R; 340/568; 340/571; 340/692; 40/455

[58] Field of Search ..... 340/384 R, 286.11, 692, 340/693, 547, 568, 571-573; 40/426, 427, 600, 621, 906, 455

[56] References Cited

U.S. PATENT DOCUMENTS 3,579,222 5/1971 Freeman ..... 340/568
3,798,806 3/1974 Sanford ..... 40/455
3,815,117 6/1974 Gopperton ..... 340/571
4,274,088 6/1981 Pierson et al. ..... 340/568

*Primary Examiner*—Donnie L. Crosland

[57] ABSTRACT

A magnet for posting notes or the like on a refrigerator wall or similar metal surface in which the magnet, in one exemplary embodiment, has a battery-operated sound-emitting device which, for added play value, is activated to produce its sound, but only when the magnet is manually removed from its support surface and otherwise, as when it is held by magnetic attraction against a support surface, a disabling switch is held open to correspondingly deactivate the sound-playing mode of the magnet.

3 Claims, 2 Drawing Sheets

MAGNET FOR USE ON A REFRIGERATOR OR THE LIKE

The present invention relates generally to improvements for what aptly can be called a "refrigerator", in that it is typically used to hold by magnetic attraction to a metallic refrigerator wall in interposed position reminder notes to do chores, children's schoolwork and other such documents, thereby making the refrigerator wall a display board, and more particularly to improvements for this convenience item which contribute play value, such as might be appropriate for a toy, to the item.

EXAMPLES OF THE PRIOR ART

It is already known to have movement of an article initiate a response. Thus, for example, in U.S. Pat. No. 1,901,589 issued to Fullmen on Mar. 14, 1933, a "Pick-Up Candle Light" is lit when the candle is lifted off of a support. And in U.S. Pat. No. 4,418,336 issued to Taylor on Nov. 29, 1983, an alarm sounds if a fire extinguisher is moved from its normal storage position.

None of the referenced or other known patents, however, contemplate the use of a magnet to hold the articles on a support surface while simultaneously holding open the switch controlling the alarm or sounding device, so that it is only when the article is physically removed from the support, by withdrawal of the magnet from the "magnetic" surface, that the sounding device embodied in the article is permitted to operate. Stated otherwise, the magnet closing against the magnetic surface is a "movement" which also opens the circuit of the alarm or sounding device, and thus terminates its operation. The article only emits a sound in its unattached condition.

Using the operational mode above noted, it is an object of the present invention to embody toy-like play value to a refrigerator magnet heretofore lacking in this attribute, and otherwise to enhance the use of this convenience item.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
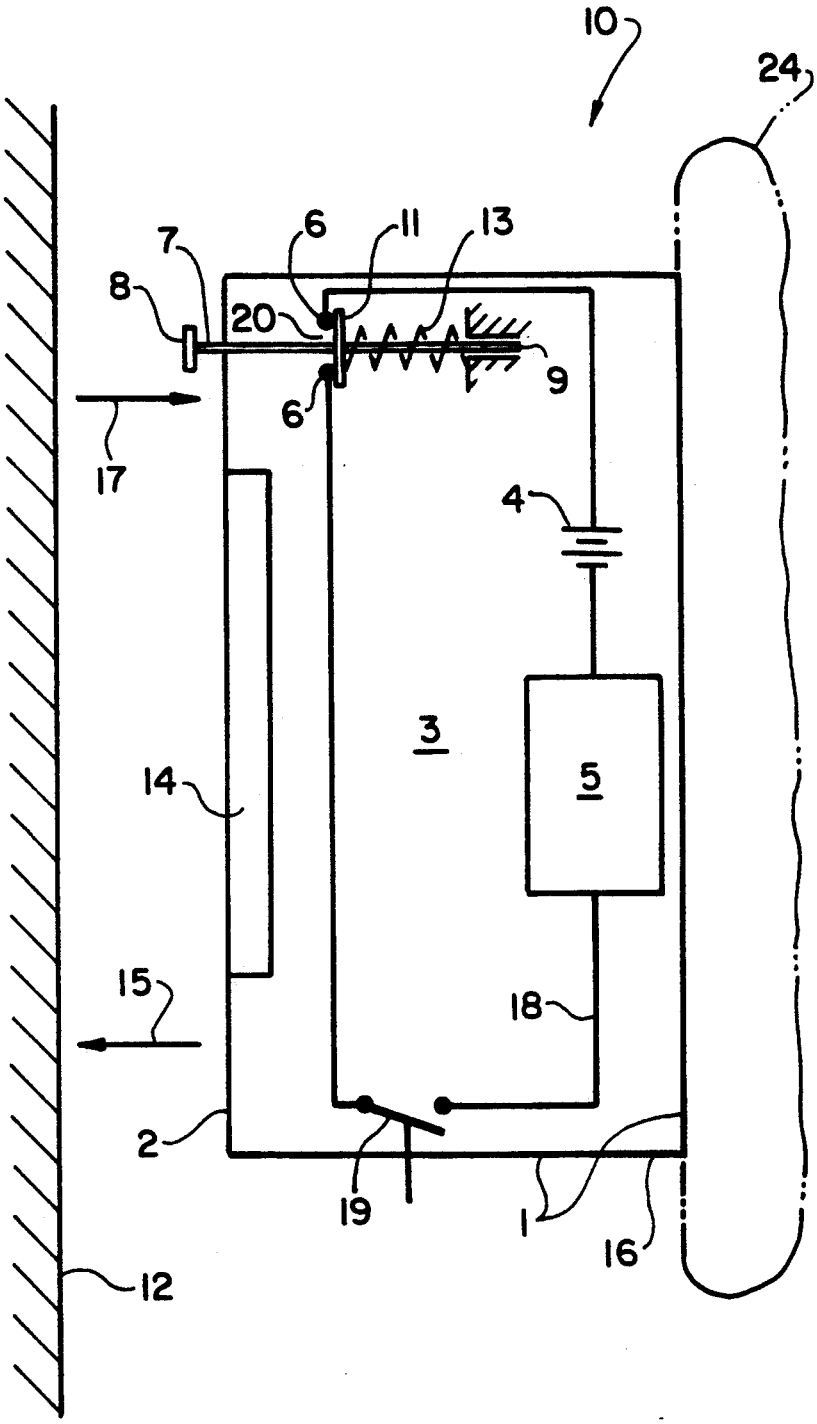
FIG. 1 is a combination schematic and wiring diagram of the within novelty magnetic play value device of the present invention.

Shown in the FIG. 1 schematic is a novelty "refrigerator magnet" 10 depicted in side elevational perspective in its typical use supported on a magnetic surface 12 by a permanent magnet 14, the surface 12 being typically a metallic exterior wall of a refrigerator and thus providing the magnetic attraction for the magnet 14. Instead of using merely a magnet 14 to hold notes, children's school work and the like for display on the refrigerator, to contribute play value the magnet 14 is embodied in a construction and provided with an electrical operating circuit as shown in FIG. 1. More particularly, the assemblage which comprises the device 10 consists of a housing 16 having plural walls 1 including a rear wall 2 which cooperate to bound an internal storage compartment 3. Disposed in compartment 3 is a battery-powered sound-emitting device 5, of any appropriate well known construction and operating mode readily commercially available, which is part of an electrical circuit 18 having a pair of spaced apart circuit contacts 6 forming an open circuit switch 20. A switch member 7 with opposite ends 8 and 9 and a transverse switch contact 11 is adapted to be biased by a spring 13 so that contact 11 closes the contacts 6 and the circuit batteries 4 operate the device 5 causing it to emit or play a selected musical tune or other sound having play value for the listener. In this operating mode, the magnet 14 is not engaged to the surface 12 and the switch member end 8 extends in a clearance position beyond the housing rear wall 2.

When, however, in accordance with its contemplated use, device 10 is brought close enough to the metallic surface 12, the magnet 14 produces an attraction which causes the device 10 to be urged through closing movement 15 and, consequently, to have its rear surface or wall 2 held flush against the surface 12. This forces the switch end 8 from its clearance position into a position of movement against the wall 2 and correspondingly moves contact 11 from its switch-closing operative position in relation to switch 20 into a clearance position opening this switch. This disables the circuit 18 from operating the device 5, and the device 10 will not emit any sound for the duration that is allowed to be held by the magnet 14 against surface 12.

From the foregoing description it should be readily appreciated that when the device 10 is manually removed from the surface 12, the spring 13 restores contact 11 to its operative position closing switch 20 and thus also restores the electrical continuity of circuit 18 to, in turn, cause the powering operation of the sound mechanism 5. Stated otherwise, and assuming that a master on-off switch 19 is closed, every time device 10 is removed from the refrigerator wall 12 it will play a selected tune or the like, to the amusement of the user.

It is to be noted that it is within the contemplation of the practice of the within invention to also use as the play-value contributing component 5 one that, instead of emitting sound, is designed to emit light, or one which might be a motor and provides a movement-imparting operating mode.

Additionally contributing to the play value of the device 10 over and beyond that of a conventional "refrigerator" magnet are selected decorations added to the face of the device, as exemplified by the commercial embodiments illustrated in FIGS. 2–6, and now to be briefly described. The embodiment of FIG. 2 has an operational mode essentially similar to that described in connection with FIG. 1 but the assemblage thereof is facilitated by the magnet 14 being adhesively or otherwise appropriately secured to the exterior of the rear wall of the main housing 16 and the switch 20 has its own housing appropriately affixed to the top of the main housing 16, the extending end 8 of the switch member 7 previously described in connection with the schematic of FIG. 1 being covered by a cap 22 and being urged within its housing by actual contact against the support surface 12 (shown in phantom perspective). The selected decoration 24 is appropriately mounted in a display position on the front face of the housing 16.

Appropriate and well understood and commercially available electrical circuits 18 are available for use to synthesize a series of sounds, present a visual display consisting, for example, of flashing lights, or have a mechanical operational mode, such as rotating, reciprocating or vibrating elements of the display 24.

Figure 3:
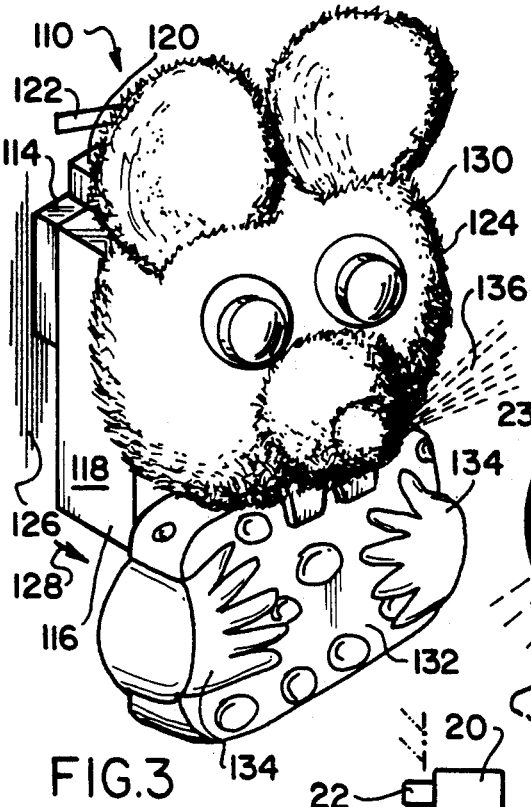
FIGS. 3–6 decorated versions of the magnetic device in which the decorations contribute to the play value thereof, these figures each being perspective views.

Thus, in FIG. 3, device 110 is presented as being lifted away from refrigerator door 126 in the direction of arrow 128 at which time switch 120 closes. Device 110 has a display 124 made to resemble a small animal and specifically, in this case, a cartoon rodent. Display 124 made of appropriate fabric and plastic members, has a head section 130 placed above a block of "cheese" 132 held by a pair of "hands" 134. Housing 116 has a magnet 114 and switch 120 mounted thereon. Within housing 116 a circuit 118 produces audible cartoon-like laughing sounds 136 each time assembly 110 is lifted away from surface 126. Circuit 118 remains silent however, when it is replaced against surface 126 or other magnetic surface.

Figure 4:
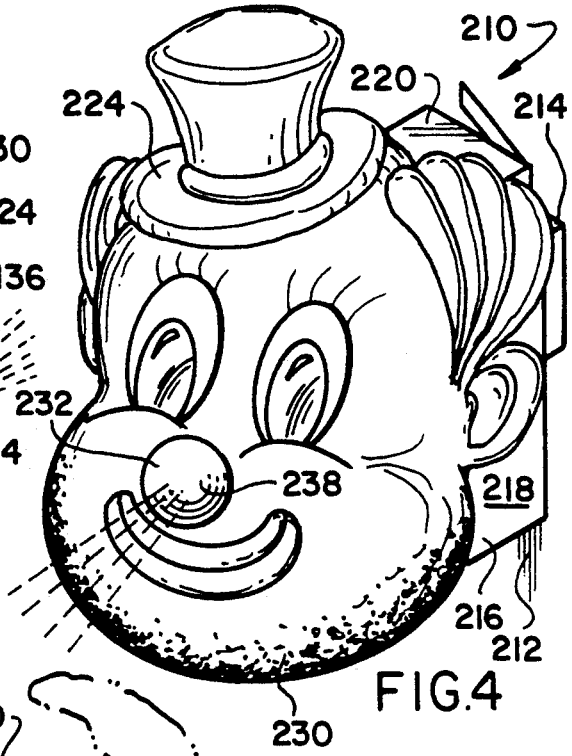
Figure 2:
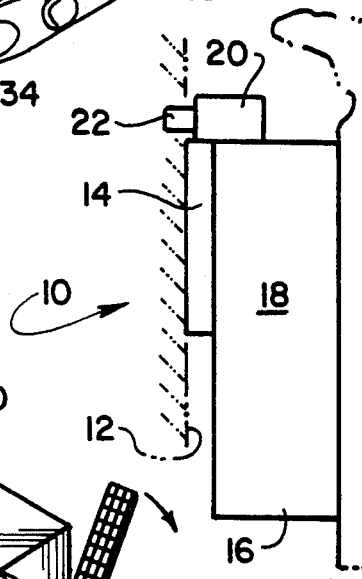
FIG. 2 is a simplified side elevational view of an embodiment of the within magnetic device having the wiring and operational mode produced thereby as illustrated in FIG. 1.

FIG. 4 shows another version of the basic "refrigerator magnet" wherein a device 210 has a magnet 214 and switch 220 attached to a housing 216. When device 210 is lifted from its respective magnetic surface 212, switch 220 closes to trigger the circuit 218 which causes a small light or LED 238 to blink on and off for a period of time. Light 238 is made to be part of the display 224. Appropriately, the display 224 is made to resemble the face of a clown 230 of which light 238 becomes the round bulbous nose 232.

Figure 5:
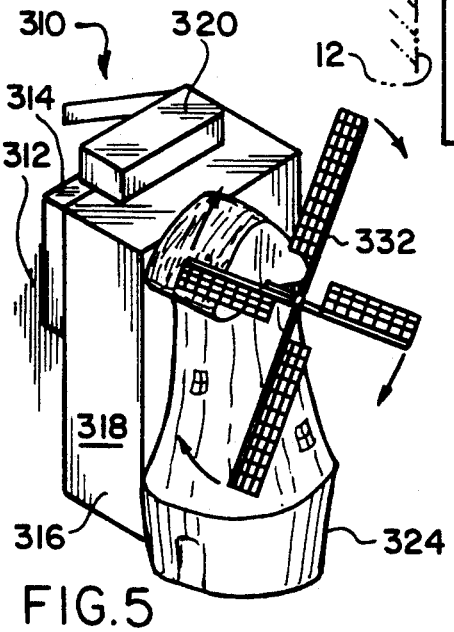

An animated version of the device 310 is portrayed in FIG. 5 in which a display 324 is presented as a windmill. Vane assembly 332 is attached to the shaft of a motor within housing 316 and powered by circuit 318 which provides rotation initiated when device 310 is lifted from surface 312. As in device 10, 110 and 210, when device 310 moves away from surface 312, switch 320 closes and circuit 318 goes through its performance cycle.

Figure 6:
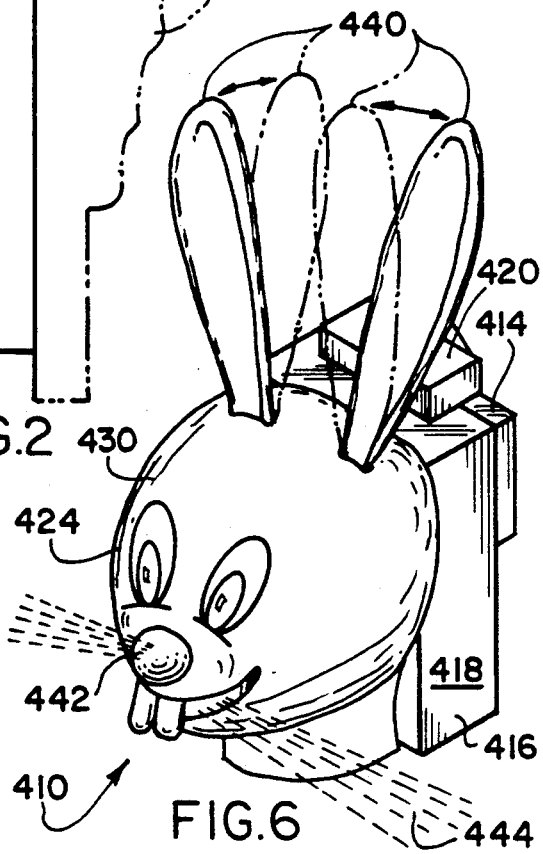

Yet another contemplated version of the device 410 is shown in FIG. 6. The device 410 having a display 424 shown as a rabbit face 430 demonstrates a combination of animation by the wriggling of rabbit ears 440, the blinking light of rabbit nose 442 and a synthesized voice making rabbit noises or sounds 444.

While the apparatus for practicing the within inventive operational mode, as well as said operational mode herein shown and disclosed in detail is fully capable of attaining the objects and providing the advantages hereinbefore stated, it is to be understood that it is merely illustrative of the presently preferred embodiments of the invention and that no limitations are intended to the detail of construction or design herein shown other than as defined in the appended claims.

What is claimed is:

1. A sound-emitting amusement device comprising a housing having plural walls including a rear wall bounding an internal storage compartment, a battery-powered sound-emitting device within said storage compartment disposed in electrical relation to an electrical circuit having a pair of spaced apart circuit contacts therein forming an open circuit switch, a switch member having a distal end disposed within said housing and a proximal end extending therefrom in a clearance position from said housing rear wall, a transverse switch contact having an operative position on said switch member relative to said circuit contacts so as to be movable from a clearance position into spanning relation therewith incident to electrically closing said open circuit switch, a spring operatively disposed to normally bias said switch contact from said clearance position into said circuit contacts-closing position and simultaneously said distal end of said switch member into said clearance position extending rearwardly of said housing rear wall, and magnet means on said housing rear wall adapted to urge said housing in a closing movement against a magnetizable support surface and to hold said housing in said supported position thereon so that coincident with said closing movement said switch member distal end is urged from said clearance position into flush relation with said housing rear wall and said switch contact on said switch member is moved into said clearance position opening said circuit contacts, whereby during an interval of use when said amusement device is maintained by magnetic attraction flush against said support surface said sound-emitting device is electrically disabled from being powered in operation by said batteries, and when removed from said support surface said spring bias restores the continuity of said circuit to cause the powering operation of said sound emission for said amusement device.

2. A light-emitting amusement device comprising a housing having plural walls including a rear wall bounding an internal compartment, a battery-powered light-emitting device within said storage compartment disposed in electrical relation to an electrical circuit having a pair of spaced apart circuit contacts therein forming an open circuit switch, a switch member having a distal end disposed within said housing and a proximal end extending therefrom in a clearance position from said housing rear wall, a transverse switch contact having an operative position on said switch member relative to said circuit contacts so as to be movable from a clearance position into spanning relation therewith incident to electrically closing said open circuit switch, a spring operatively disposed to normally bias said switch contact from said clearance position into said circuit contacts-closing position and simultaneously said distal end of said switch member into said clearance position extending rearwardly of said housing rear wall, and magnet means on said housing rear wall adapted to urge said housing in closing movement against a magnetizable support surface and to hold said housing in said supported position thereon so that coincident with said closing movement said switch member distal end is urged from said clearance position into flush relation with said housing rear wall and said switch contact on said switch member is moved into said clearance position opening said circuit contacts, whereby during an interval of use when said amusement device is maintained by magnetic attraction flush against said support surface said light support surface said spring bias restores the continuity of said circuit to cause the powering operation of said light emission for said amusement device.

3. A movement-partaking amusement device comprising a housing having plural walls including a rear wall bounding an internal storage compartment, a battery-powered movement-partaking device within said storage compartment disposed in electrical relation to an electrical circuit having a pair of spaced apart circuit contacts therein forming an open circuit switch, a switch member having a distal end disposed within said housing and a proximal end extending therefrom in a clearance position from said housing rear wall, a transverse switch contact having an operative position on said switch member relative to said circuit contacts so as to be movable from a clearance position into spanning relation therewith incident to electrically closing said open circuit switch, a spring operatively disposed to normally bias said switch contact from said clearance position into said circuit contacts-closing position and simultaneously said distal end of said switch member into said clearance position extending rearwardly of said housing rear wall, and magnet means on said housing rear wall adapted to urge said housing in closing movement against a magnetizable support surface and to hold said housing in said supported position thereon so that coincident with said closing movement said switch member distal end is urged from said clearance position into flush relation with said housing rear wall and said switch contact on said switch member is moved into said clearance position opening said circuit contacts, whereby during an interval of use when said amusement device is maintained by magnetic attraction flush against support surface said movement-partaking device is electrically disabled from being powered in operation by said batteries, and when removed from said support surface said spring bias restores the continuity of said circuit to cause the powering operation of said movements for said amusement device.

* * * * *